US009670049B2

(12) United States Patent
Apps

(10) Patent No.: US 9,670,049 B2
(45) Date of Patent: Jun. 6, 2017

(54) PLASTIC BEER KEG

(71) Applicant: Rehrig Pacific Company, Los Angeles, CA (US)

(72) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 19 days.

(21) Appl. No.: 14/747,618

(22) Filed: Jun. 23, 2015

(65) Prior Publication Data

US 2015/0368084 A1 Dec. 24, 2015

Related U.S. Application Data

(60) Provisional application No. 62/015,733, filed on Jun. 23, 2014.

(51) Int. Cl.

*B67D 1/08* (2006.01)
*B67D 1/04* (2006.01)
*B67D 1/12* (2006.01)

(52) U.S. Cl.

CPC ..... *B67D 1/0832* (2013.01); *B67D 1/0462* (2013.01); *B67D 1/0801* (2013.01); *B67D 1/0841* (2013.01); *B67D 1/125* (2013.01); *B67D 1/0804* (2013.01); *B67D 2001/0822* (2013.01)

(58) Field of Classification Search

CPC .... B67D 1/0832; B67D 1/125; B67D 1/0841; B67D 1/0801; B67D 1/0462; B67D 2001/0822; B67D 1/0804

USPC ..... 222/518, 482; 220/254.1, 327

See application file for complete search history.

(56) References Cited

U.S. PATENT DOCUMENTS

| | | | |
|---|---|---|---|
| 2,090,403 | A | 8/1937 | Murray et al. |
| 2,104,466 | A | 1/1938 | Marzolf |
| 2,110,840 | A | 3/1938 | Kann |
| 2,357,245 | A | 8/1944 | Wetherby et al. |
| 2,447,390 | A | 8/1948 | Brand |

(Continued)

FOREIGN PATENT DOCUMENTS

| | | | |
|---|---|---|---|
| CA | 828983 | A | 12/1969 |
| CA | 1005406 | A1 | 2/1977 |

(Continued)

OTHER PUBLICATIONS

Partial European Search Report for European Application No. 15173464.7 completed Nov. 25, 2015.

*Primary Examiner* — Donnell Long

(74) *Attorney, Agent, or Firm* — Carlson, Gaskey & Olds PC

(57) ABSTRACT

A beer keg assembly includes a liner or bottle having a body portion and a neck portion. A valve assembly is in the neck portion of the liner. The valve assembly includes an inner retainer portion having an inner annular surface formed on a portion of reduced diameter. A cap is secured to the inner retainer portion. At least one spring imparting force between the cap and the inner annular surface. The at least one spring may include an inner spring biasing a piston and a port against one another. The at least one spring may further include an outer spring, wherein the inner spring and the outer spring are both captured between the inner annular surface and the cap. A pressure relief valve may be disposed in a fluid path leading through a wall of the inner retainer portion.

35 Claims, 6 Drawing Sheets

(56) References Cited

U.S. PATENT DOCUMENTS 3,124,267 A 3/1964 Cetrone
3,140,007 A 7/1964 Nettleship
3,217,947 A 11/1965 Bauerlein
3,244,326 A 4/1966 Bull, Jr.
3,251,386 A 5/1966 Bellato
3,283,530 A 11/1966 Bayne et al.
3,361,152 A 1/1968 Akers
3,433,389 A 3/1969 Puster
3,494,514 A 2/1970 Johnston
3,698,417 A 10/1972 Smith et al.
3,768,706 A 10/1973 Hill
3,825,145 A 7/1974 Reynolds
3,827,515 A 8/1974 Hutchinson et al.
3,840,141 A 10/1974 Drucker et al.
3,848,631 A 11/1974 Fallon
3,906,986 A 9/1975 Zurit et al.
3,908,871 A 9/1975 Gottwald
3,933,282 A 1/1976 Stevens, Jr.
3,952,904 A 4/1976 Verlinden
4,007,848 A 2/1977 Snyder
4,007,850 A 2/1977 Beaugrand
4,027,777 A 6/1977 Blanke, Jr.
4,032,047 A 6/1977 Wilson
4,035,893 A 7/1977 Zurit et al.
4,114,670 A 9/1978 Akashi et al.
4,164,309 A 8/1979 Staats
4,171,004 A 10/1979 Cerrato et al.
4,180,189 A * 12/1979 Zurit ..... B67D 1/0832 137/212
4,265,374 A 5/1981 Sebalos
4,319,612 A 3/1982 Golding
4,481,969 A 11/1984 Fallon et al.
4,482,067 A 11/1984 Saito et al.
4,491,247 A 1/1985 Nitchman et al.
4,519,219 A 5/1985 Prepodnik et al.
4,520,953 A 6/1985 Fallon
4,531,656 A 7/1985 Nitchman et al.
4,635,814 A 1/1987 Jones
4,728,010 A 3/1988 Johnston
4,775,072 A 10/1988 Lundblade et al.
4,799,597 A 1/1989 Mayes et al.
4,867,348 A 9/1989 Dorfman
5,044,514 A 9/1991 Portat et al.
5,046,634 A 9/1991 McFarlin et al.
5,117,999 A 6/1992 Canzano
5,129,534 A 7/1992 Dunn
5,165,569 A 11/1992 Furuhashi et al.
5,203,470 A 4/1993 Brown
5,222,620 A 6/1993 Lima et al.
5,238,150 A 8/1993 Williams et al.
5,267,669 A 12/1993 Dixon et al.
5,332,132 A 7/1994 Schuske
5,345,666 A 9/1994 Matyja
5,375,741 A 12/1994 Harris
5,415,329 A 5/1995 Westlund
5,565,149 A 10/1996 Page et al.
5,595,208 A 1/1997 Augustinus et al.
5,597,085 A 1/1997 Rauworth et al.
5,657,911 A 8/1997 Mogler et al.
5,664,702 A 9/1997 Beauchamp
5,718,161 A 2/1998 Beadle
5,833,098 A 11/1998 Gomi
5,839,711 A 11/1998 Bieck et al.
5,871,121 A 2/1999 Hashimoto et al.
5,897,016 A 4/1999 Wheaton
5,984,132 A 11/1999 Dinouard et al.
6,196,277 B1 3/2001 Till et al.
6,230,922 B1 5/2001 Rasche et al.
6,260,823 B1 7/2001 Weber
6,308,858 B1 10/2001 Koefelda
6,343,916 B1 2/2002 Bougamont et al.
6,415,959 B1 7/2002 Bougamont et al.
6,502,725 B1 1/2003 Alexander
6,530,400 B2 3/2003 Nelson
6,626,314 B1 9/2003 McHenry et al.
6,666,358 B1 12/2003 Field
6,669,051 B1 12/2003 Phallen et al.
6,748,789 B2 6/2004 Turner et al.
6,751,981 B1 6/2004 Burnette
6,805,267 B2 10/2004 Bougamont
6,916,277 B2 7/2005 Chen
7,044,292 B2 5/2006 Nall
7,048,140 B1 5/2006 Caldwell
7,134,578 B2 11/2006 Bougamont
7,174,762 B2 2/2007 Turner et al.
7,258,127 B1 8/2007 Schneider
7,337,908 B2 3/2008 Dedmon
7,380,762 B2 6/2008 Takeichi
7,455,082 B2 11/2008 Monzel et al.
7,546,935 B2 6/2009 Wheaton
7,597,124 B2 10/2009 Litto
7,669,725 B2 3/2010 Randolph et al.
7,681,749 B2 3/2010 Peronek
7,721,567 B2 5/2010 Dalton et al.
7,789,265 B2 9/2010 Kearney et al.
7,819,286 B2 10/2010 Antheil et al.
8,053,194 B2 11/2011 Shinya et al.
8,113,477 B2 2/2012 Kaemmer
8,348,086 B2 1/2013 Apps
8,684,240 B2 4/2014 Sauer et al.
8,783,635 B2 7/2014 Kamiya et al.
8,807,504 B2 8/2014 Ogawa
8,820,571 B2 9/2014 Apps
8,844,555 B2 9/2014 Schneider
8,967,407 B2 3/2015 Apps
9,045,325 B2 6/2015 Apps et al.
9,051,167 B2 6/2015 Burge et al.
9,434,505 B2 9/2016 Apps
9,475,607 B2 10/2016 Apps
2002/0112776 A1 8/2002 Nelson
2004/0026461 A1 2/2004 Bougamont et al.
2004/0124216 A1 7/2004 Payne et al.
2005/0127111 A1* 6/2005 Van der Klaauw .. B67D 1/0831 222/400.7
2005/0268985 A1 12/2005 Litto
2006/0049213 A1 3/2006 Wheaton
2008/0251542 A1 10/2008 Rossignol
2008/0277001 A1 11/2008 Wheaton
2009/0014446 A1 1/2009 Grittmann
2009/0044561 A1 2/2009 Dalton et al.
2009/0206505 A1 8/2009 Monzel et al.
2009/0211647 A1 8/2009 Anderson et al.
2009/0320264 A1 12/2009 Berger et al.
2010/0018994 A1 1/2010 Antheil et al.
2010/0072212 A1 3/2010 Howard et al.
2010/0077790 A1 4/2010 Apps
2010/0096040 A1 4/2010 Litto
2010/0102071 A1 4/2010 Wauters et al.
2010/0102087 A1 4/2010 Meike et al.
2010/0230434 A1 9/2010 Dalton et al.
2010/0264140 A1 10/2010 Apps
2011/0017737 A1 1/2011 Apps
2011/0024424 A1 2/2011 Van De Klippe et al.
2011/0180535 A1 7/2011 Apps
2011/0225725 A1 9/2011 Kersten
2012/0000918 A1 1/2012 Deane et al.
2012/0138161 A1 6/2012 Wolthers
2012/0187153 A1 7/2012 Burge et al.
2013/0126009 A1 5/2013 Killarney et al.
2013/0180594 A1 7/2013 Schneider
2015/0108175 A1 4/2015 Wauters

FOREIGN PATENT DOCUMENTS

CA 2325270 A1 5/2001
CA 2438608 A1 8/2002
CA 2568761 A1 12/2005
DE 19958958 A1 6/2000
EP 19405 A1 9/1983
EP 175143 A2 3/1986
EP 1095897 A1 5/2001
EP 1099661 A1 5/2001
EP 949195 B1 9/2002
EP 1277695 A1 1/2003

(56) References Cited

FOREIGN PATENT DOCUMENTS

| | | | |
|---|---|---|---|
| EP | 1270499 | A1 | 12/2005 |
| EP | 1947029 | A1 | 7/2008 |
| EP | 2281753 | A1 | 2/2011 |
| EP | 2368809 | A1 | 9/2011 |
| EP | 1888450 | B1 | 11/2012 |
| EP | 2704982 | A1 | 3/2014 |
| EP | 2841375 | A2 | 3/2015 |
| FR | 2665688 | A1 | 2/1992 |
| GB | 437295 | | 10/1935 |
| GB | 1549733 | A | 8/1979 |
| GB | 2000485 | B | 1/1982 |
| GB | 2162900 | A | 2/1986 |
| GB | 2182319 | A | 5/1987 |
| GB | 2188040 | A | 9/1987 |
| GB | 2209740 | A | 5/1989 |
| GB | 2232446 | A | 12/1990 |
| GB | 2246768 | A | 2/1992 |
| GB | 2283967 | A | 5/1995 |
| GB | 2410936 | A | 8/2005 |
| GB | 2417235 | B | 7/2008 |
| GB | 2480832 | A | 12/2011 |
| JP | 07028156 | Y2 | 6/1995 |
| JP | 08053193 | A | 2/1996 |
| JP | 08053194 | A | 2/1996 |
| JP | 2000117216 | A | 4/2000 |
| JP | 2001072131 | A | 3/2001 |
| JP | 2002068382 | A | 3/2002 |
| JP | 2004352349 | A | 12/2004 |
| JP | 2005289467 | A | 10/2005 |
| JP | 2007039083 | A | 2/2007 |
| JP | 3942064 | B2 | 7/2007 |
| JP | 3942964 | B2 | 7/2007 |
| JP | 2007245041 | A | 9/2007 |
| JP | 2008189326 | A | 8/2008 |
| JP | 2008536767 | A | 9/2008 |
| JP | 4275117 | B2 | 6/2009 |
| JP | 2009298456 | A | 12/2009 |
| JP | 5072770 | B2 | 11/2012 |
| JP | 5075165 | B2 | 11/2012 |
| JP | 2014513018 | A | 5/2014 |
| WO | 9011963 | A1 | 10/1990 |
| WO | 9112191 | A1 | 8/1991 |
| WO | 9406703 | A1 | 3/1994 |
| WO | 9939990 | A1 | 8/1999 |
| WO | 0135060 | A1 | 5/2001 |
| WO | 0158802 | A1 | 8/2001 |
| WO | 02066363 | A1 | 8/2002 |
| WO | 03093163 | A1 | 11/2003 |
| WO | 2004063087 | A1 | 7/2004 |
| WO | 2005113416 | A1 | 12/2005 |
| WO | 2006021753 | A1 | 3/2006 |
| WO | 2005113371 | A3 | 7/2006 |
| WO | 2006110948 | A1 | 10/2006 |
| WO | 2008013819 | A2 | 1/2008 |
| WO | 2008083782 | A2 | 7/2008 |
| WO | 2008087206 | A1 | 7/2008 |
| WO | 2008101275 | A1 | 8/2008 |
| WO | 2010120347 | A2 | 10/2010 |
| WO | 2011006212 | A1 | 1/2011 |
| WO | 2011088329 | A2 | 7/2011 |
| WO | 2011093970 | A1 | 8/2011 |
| WO | 2012054967 | A1 | 5/2012 |
| WO | 2013159159 | A2 | 10/2013 |
| WO | 2014182531 | A1 | 11/2014 |

* cited by examiner

PLASTIC BEER KEG

BACKGROUND

A known plastic beer keg includes an outer container with a lid having an opening therethrough. A liner or bottle includes a body portion and a neck portion. The neck portion is adjacent the opening through the lid. A valve assembly is received in the neck portion of the liner. The valve assembly is secured to external threads on the neck portion of the liner.

SUMMARY

A beer keg assembly includes a liner or bottle having a body portion and a neck portion. A valve assembly is in the neck portion of the liner. The valve assembly includes an inner retainer portion having an inner annular surface formed on a portion of reduced diameter. A cap is secured to the inner retainer portion. At least one spring imparting force between the cap and the inner annular surface. The at least one spring may include an inner spring biasing a piston and a port against one another. The at least one spring may further include an outer spring, wherein the inner spring and the outer spring are both captured between the inner annular surface and the cap. A pressure relief valve may be disposed in a fluid path leading through a wall of the inner retainer portion.

DETAILED DESCRIPTION OF THE PREFERRED EMBODIMENTS

Figure 1:
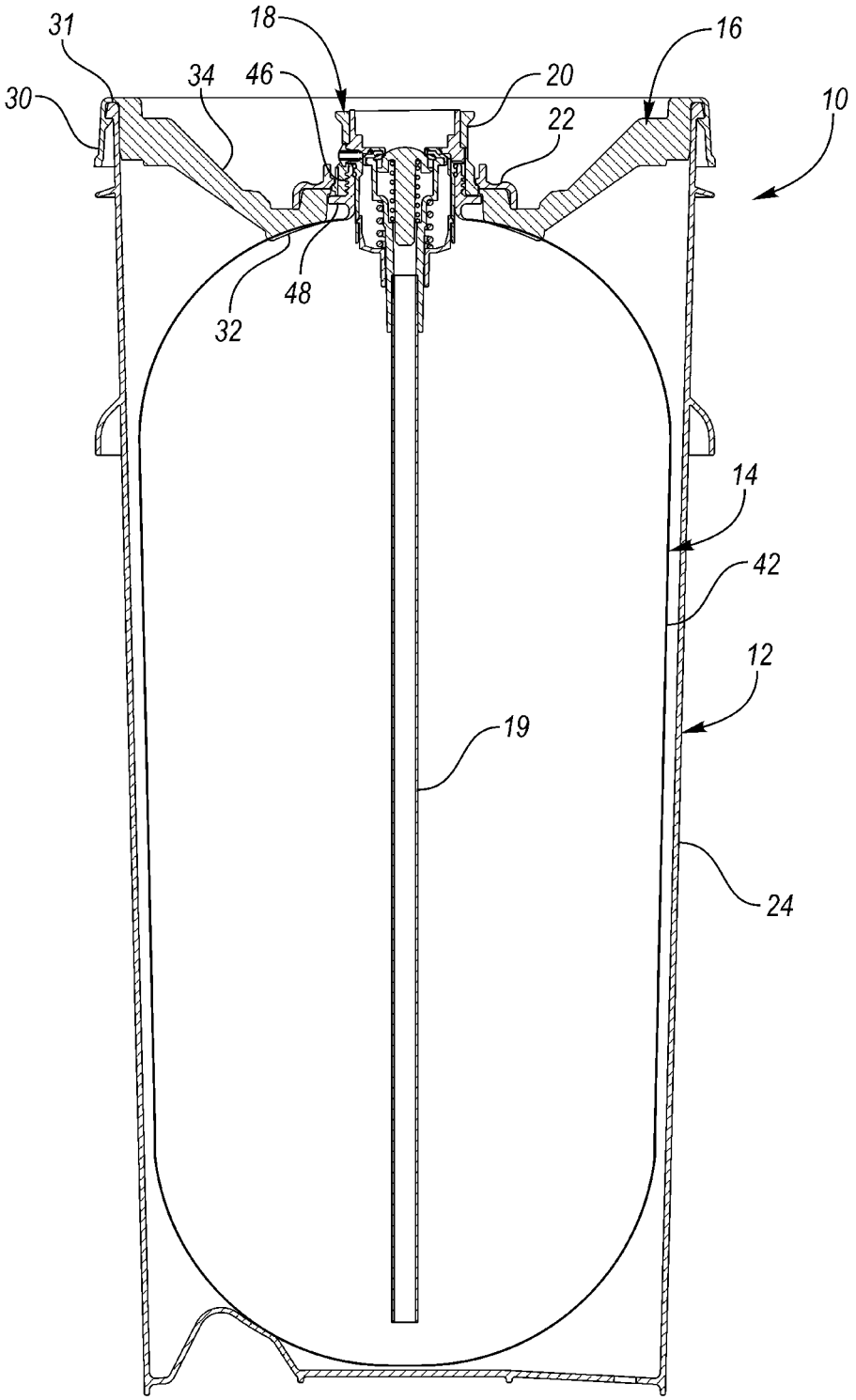
FIG. 1 is a section view through a beer keg assembly according to one embodiment.

FIG. 1 shows a plastic beer keg 10 including an outer container 12 surrounding an inner liner 14, such as a PET bottle. A lid 16 is secured over an open end of the outer container 12 to retain the liner 14 within the interior of the outer container 12. A valve assembly 18 is retained in the mouth of the liner 14 by its outer retainer 20, which is part of the valve assembly 18 and which protrudes through an opening in the lid 16. The valve assembly 18 is shown in more detail in the subsequent figures.

A fastener, in this case a locking ring 22, is secured to the outer retainer 20 to secure the outer retainer 20 to the lid 16. In this example, the locking ring 22 is threaded to the outer retainer 20 to prevent the outer retainer 20 from moving downwardly through the opening in the lid 16.

The outer container 12 includes a tapered cylindrical outer wall 24 having an upper end to which the lid 16 is snap-fit or threaded. The lid 16 includes a lip 30 extending downward from a generally horizontal, annular rim portion 31 extending about the periphery of the lid 16 and over the upper edge of the outer wall 24 of the outer container 12. The lid 16 further includes a lower annular wall 32 spaced below the upper edge of the outer container 12 and connected by a frustoconical wall 34 to the outer periphery of the lid 16.

The liner 14 is a PET bottle or other suitable material having a body portion 42 and a neck 46, which as shown, may be threaded. A neck ring 48 (preferably, but not critically hexagonal or other non-circular shape) is integrally molded around the neck 46.

The outer retainer 20 of the valve assembly 18 is securable to the neck 46 of the liner 14 (such as by threading) in order to retain the valve assembly 18 within the neck 46. A semi-flexible tube 19 extends downward from the valve assembly 18 into the liner 14. The outer container 12, the lid 16, and the outer retainer 20 may each be separately molded of HDPE, polypropylene or other suitable materials.

Figure 2:
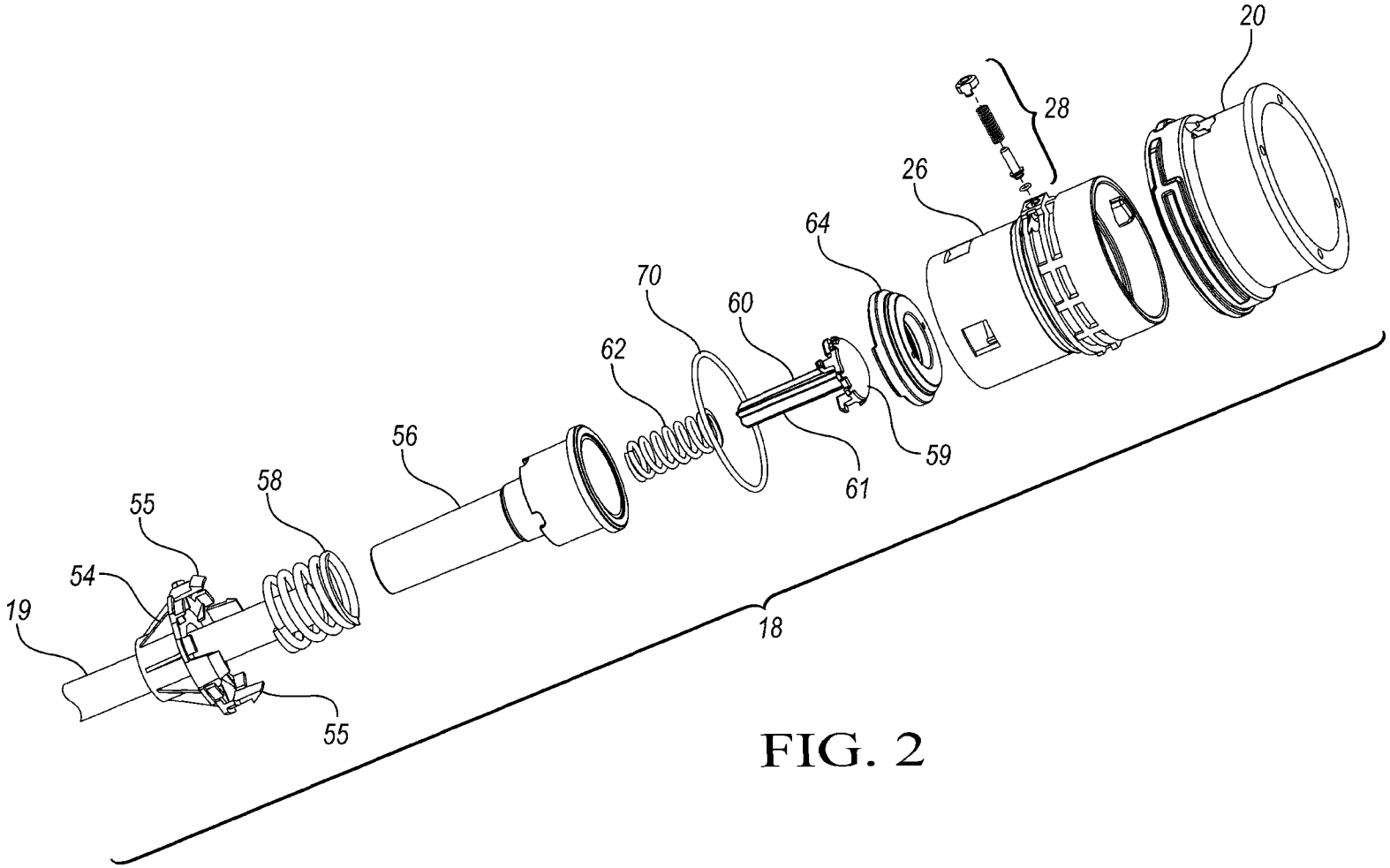
FIG. 2 is an exploded perspective view of the valve assembly of FIG. 1.

An exploded view of the valve assembly 18 is shown in FIG. 2. A retainer cap 54 has a plurality of snap-fit fingers 55. A valve body 56 received in the retainer cap 54 is connected to the tube 19 and biased away from the retainer cap 54 by an outer spring 58. A port 60 is received in the valve body 56 and biased away from the valve body 56 by an inner spring 62 toward a piston 64. The piston 64 is generally annular having an aperture therethrough. The port 60 includes a head portion 59 having a convex upper surface and an elongated stem portion 61 below the head portion 59. The head portion 59 seals against the piston 64, selectively closing the aperture through the piston 64. The piston 64 is received in an inner retainer 26, having an annular wall within which the rest of the components are at least partially received. The outer retainer 20 may include an annular wall having external threads (for connection to the locking ring 22, FIG. 1). A pressure relief valve assembly 28 is insertable radially into the annular wall of the inner retainer 26. An o-ring 70 may be provided on the inner retainer 26.

The inner retainer 26 and retainer cap 54 may be formed from POM which has good creep resistance and stiffness (to contain the outer spring 58) and which is rated highly for contact with food (in this case, beer). The outer retainer 20 may be formed of a higher strength, more durable material, such as glass-filled nylon, because the outer retainer 20 does not contact the beer. The outer retainer 20 is important to the strength and durability of the keg 10 because it connects the valve assembly 18 to the neck of the liner 14 and connects to the locking ring 22 which clamps the lid 16 between the liner 14 and locking ring 22.

Figure 3:
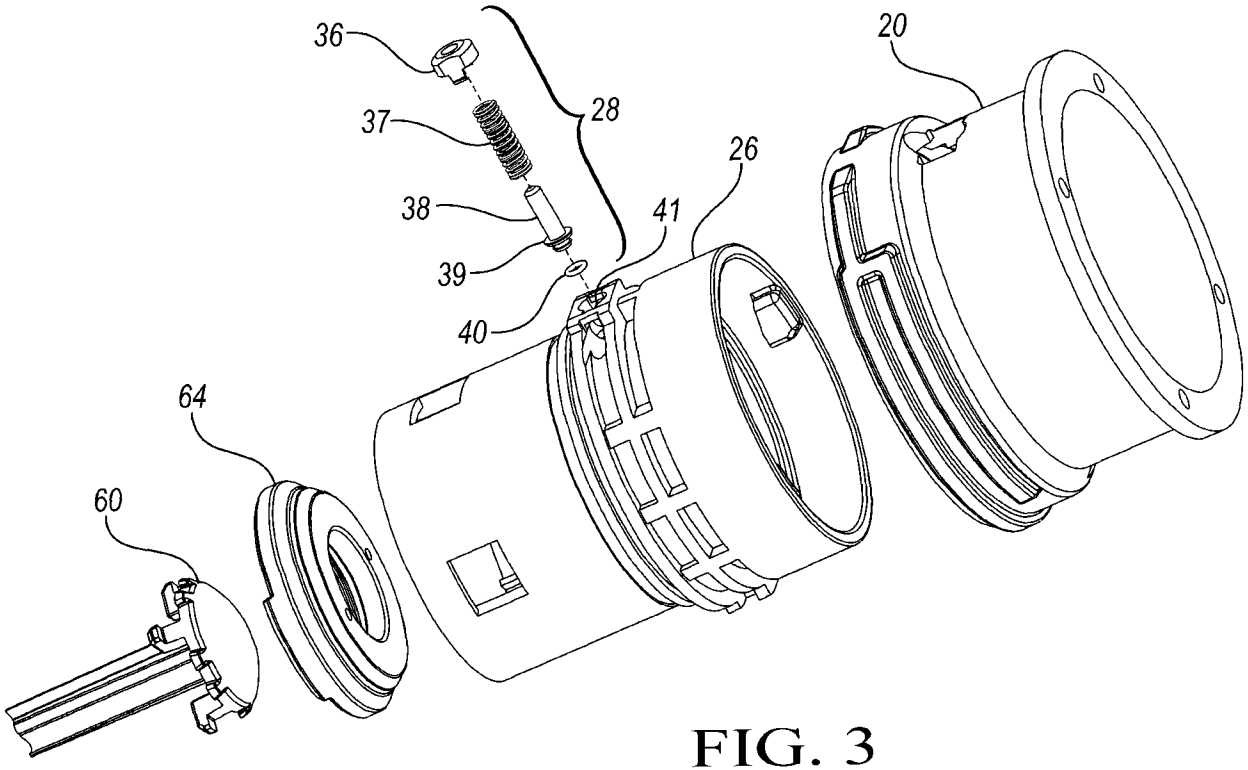
FIG. 3 is an exploded perspective view of the inner and outer retainer of FIG. 2.

FIG. 3 is an enlarged view of the upper portion of FIG. 2. The pressure relief valve assembly 28 includes a cap 36 (which may be POM) having an aperture therethrough, a spring 37 (which may be stainless steel), a piston 38 (which may be POM), the piston 38 having a sealing surface 39 and an o-ring 40 (which may be EPDM). The pressure relief valve assembly 28 is configured to be received in a radial bore 41 through the annular wall of the inner retainer 26. In use, if the pressure inside the liner 14 ever exceeds a predetermined pressure (e.g. about 65-70 psi), the outward force on the piston 38 will overcome the spring 37. The piston 38 moves away from the sealing surface of the inner retainer 26 against which it seals, thus permitting fluid to exit the liner 14 until the pressure in the liner 14 drops below the threshold pressure. The released fluid flows between sealing surface 39 of the piston 38 and the o-ring 40, along the piston 38 (which has a diameter less than the radial bore 41) and through the aperture in the cap 36. This may prevent potential overpressure situations from getting high enough to cause damage to the keg 10. If the keg 10 is in an upright position and is being filled (or just increasing in temperature), the fluid that is released from the keg 10 through the pressure relief vale assembly 28 should be mostly CO2 because the pressure relief valve assembly 28 is at the top of the keg 10. After the pressure is reduced sufficiently, the spring 37 forces the piston 38 to seal against the o-ring 40 again.

The outer retainer 20 is securable to the inner retainer 26, such as by threading or a snap-fit connection. As shown, the pressure relief valve assembly 28 is receivable in a radial bore 41 through an annular wall of the inner retainer 26.

Figure 4:
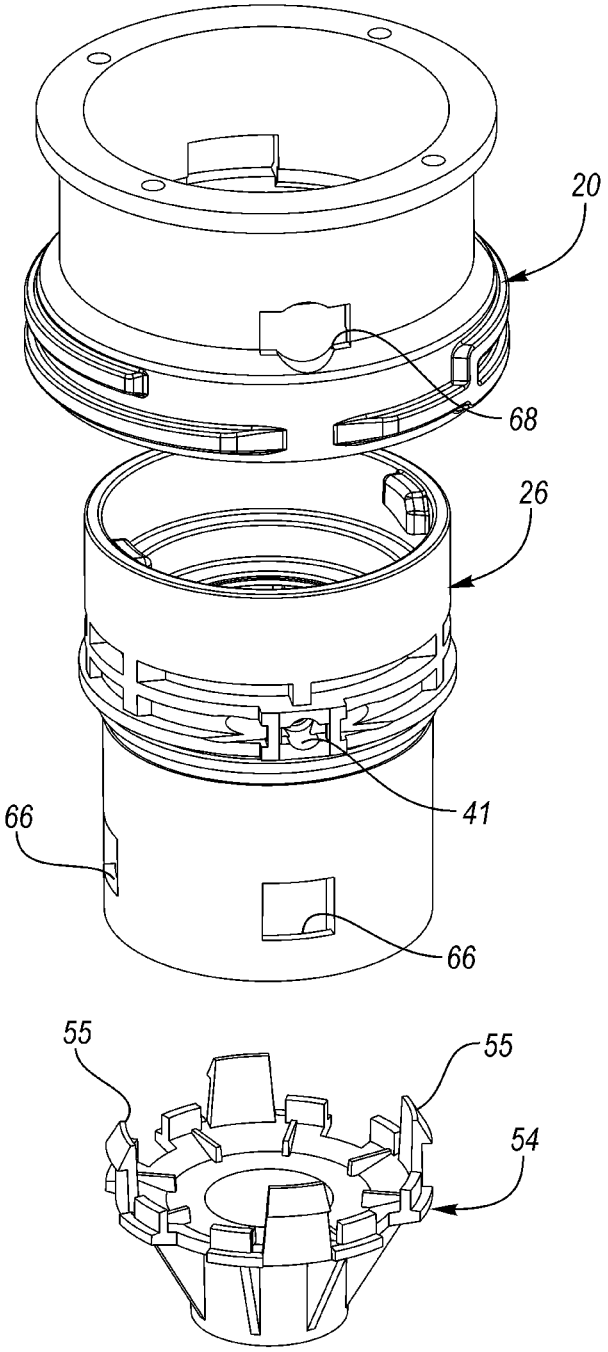
FIG. 4 is an exploded perspective view of the inner and outer retainers and cap of FIG. 2.

FIG. 4 is an exploded view of the retainer assembly including outer retainer 20, inner retainer 26 and retainer cap 54. The retainer cap 54 has a plurality of snap-fit fingers 55 that are complementary to openings 66 through the annular wall of the inner retainer 26 for securing the retainer cap 54 to the inner retainer 26. The outer retainer 20 includes an aperture 68 configured to align with the radial bore 41 in the inner retainer assembly 26 and the pressure relief valve assembly 28 (FIG. 3). The radial bore 41 and the aperture 68 align to provide a flow path from the body of the liner 14 to the exterior (atmosphere) of the keg 10.

Figure 5:
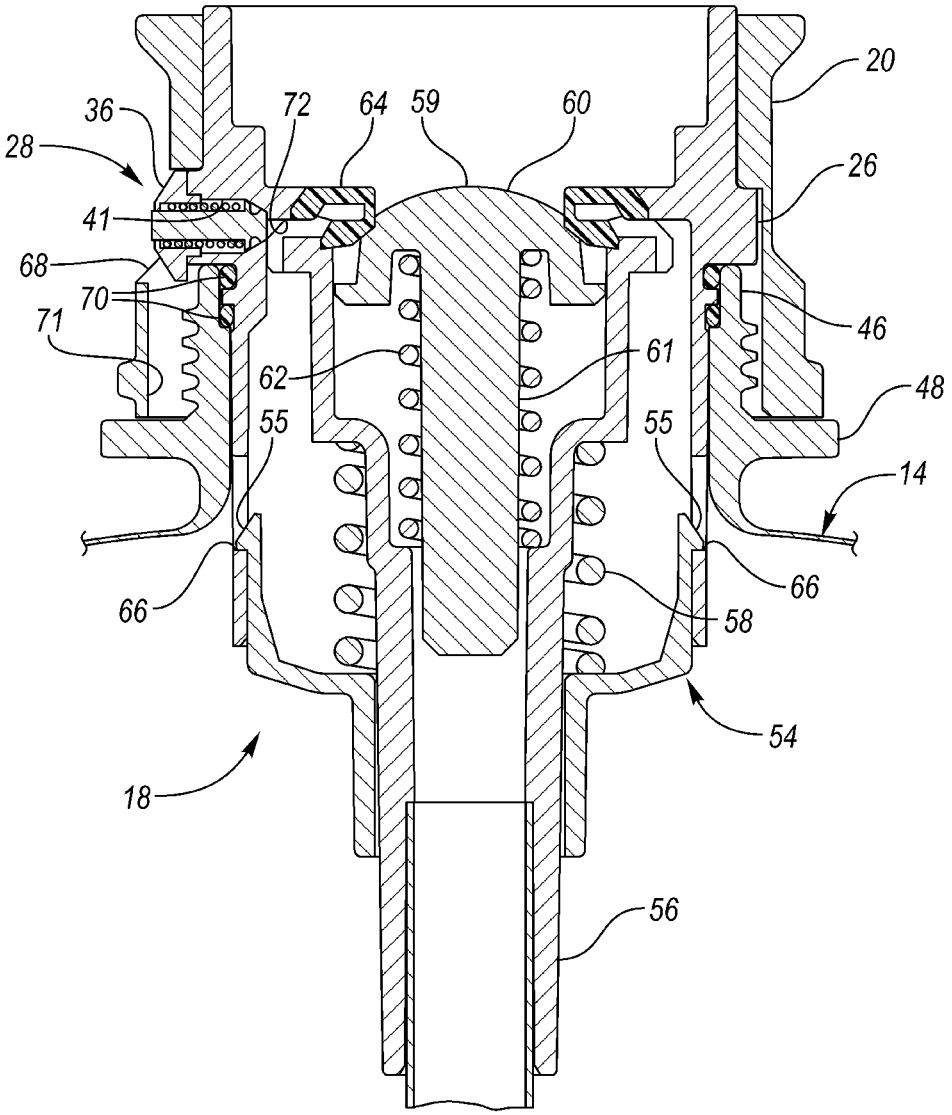
FIG. 5 is a section view through an assembled valve assembly of FIG. 1.

FIG. 5 is a section view through the assembled valve assembly 18 installed on the liner 14 (i.e. without the lid 16 or locking ring 22). The outer retainer 20 is connected to the inner retainer 26 and leaves an annular gap between them in a lower portion of the assembly. At least a portion of the neck 46 of the liner 14 is received within the annular gap and may be secured to the neck 46 by threads, snap-fit, etc. The o-ring 70 creates a seal between the inner retainer 26 and the neck 46 on an inside surface of the neck 46. This prevents damage to the o-ring 70 when the retainer assembly is attached to the neck 46. Another o-ring (not shown) can be placed in the annular recess above the o-ring 70 in addition to or instead of the o-ring 70. The radial bore 41 and the aperture 68 are both above the neck 46 of the liner 14. The flowpath through the radial bore 41 is just below where the piston 64 seals against an annular surface of the inner retainer 26. The pressure relief valve assembly 28 is shown in the radial bore 41 of the inner retainer 26 with the cap 36 received partially in the aperture 68 through the outer retainer 20. When the inner retainer 26 is slid into the outer retainer 20, the cap 36 slides through an axial groove 71 formed in the inner surface of the annular wall of the outer retainer 20, extending from the lower edge to the aperture 68.

As can be seen in FIG. 5, the force of the compressed spring 58 is contained entirely between the retainer cap 54 and the inner retainer 26. Thus, the retainer cap 54 and inner retainer 26 are made of a more dimensionally stable material that resists creep, such as POM, which is also suitable for direct contact with food (beer). This means that the force of the spring 58 does not bear on the connection between the outer retainer 20 and the neck 46 of the liner 14. Further, the outer retainer 20 can be made of a more durable material, such as glass-filled nylon, to provide a stronger, more durable connection to the locking ring 22 (but does not directly contact the beer). The spring 58 is directly between the retainer cap 54 and the valve body 56, biasing the valve body 56 upward within the retainer assembly against the piston 64. The piston 54 bears against an inner annular surface 72 formed on a portion of reduced inner diameter of the inner retainer 26 above the pressure relief bore 41 through the inner retainer 26. The inner spring 62 is captured between the valve body 56 and the port 60, biasing the port 60 upward against the piston 64. Thus, both of the springs 58, 62 are captured within the valve assembly 18 and the forces of the springs 58, 62 do not bear on the connection between the valve assembly 18 and the liner 14.

Figure 6:
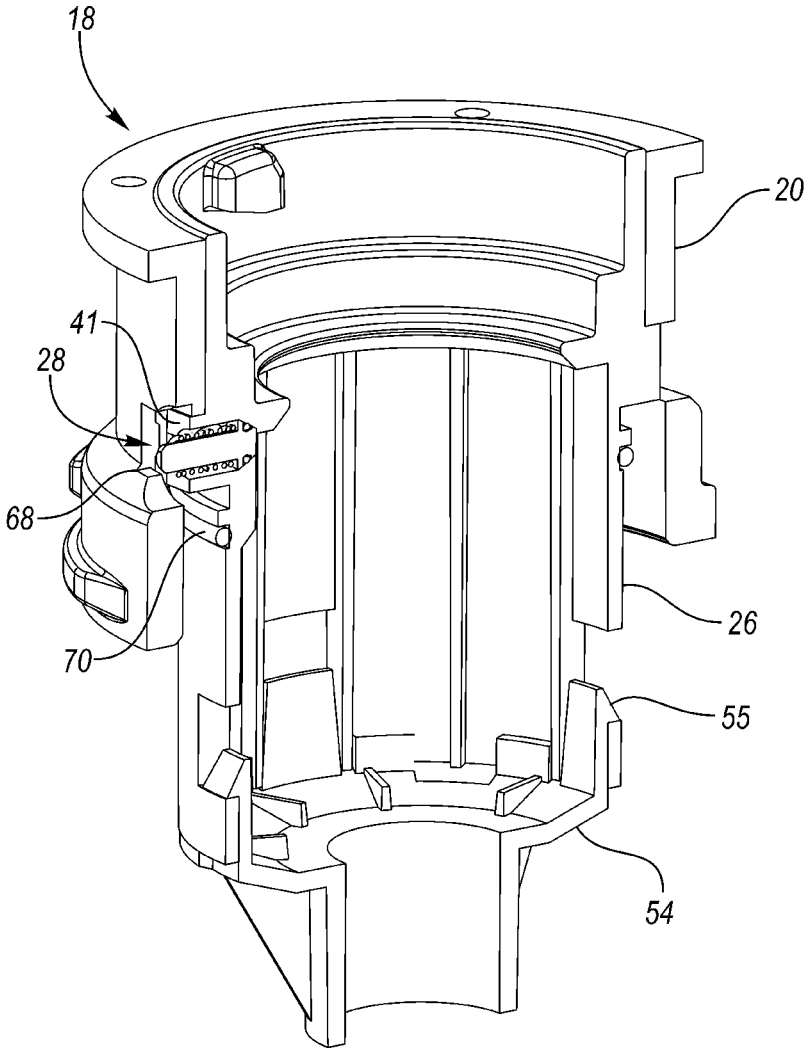
FIG. 6 is a perspective view, partially broken away, of the assembled inner and outer retainers and cap.

FIG. 6 is a perspective cutaway of the outer retainer 20, inner retainer 26 and retainer cap 54 assembled together with the pressure relief valve assembly 28 installed in the radial bore 41 of the inner retainer 26.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A beer keg assembly comprising:

a liner having a body portion and a neck portion, the neck portion including an outer circumferential surface; and a valve assembly in the neck portion of the liner, the valve assembly including a retainer capturing an inner spring biasing a port and a piston toward one another, wherein the valve assembly is secured to the outer circumferential surface of the neck portion of the liner such that the inner spring does not impart force on a connection between the valve assembly and the neck portion.

2. The beer keg assembly of claim 1 wherein a connection between the valve assembly and the neck portion is a threaded connection.

3. The beer keg assembly of claim 1 wherein the retainer includes an inner retainer portion having an inner annular surface formed on a portion of reduced diameter against which force from the inner spring bears via the port and the piston.

4. The beer keg assembly of claim 3 wherein the retainer includes a cap secured to a lower end of the inner retainer portion and wherein the force from the inner spring bears against the cap, such that the force of the inner spring is captured between the cap and the inner annular surface of the inner retainer portion.

5. The beer keg assembly of claim 1 further including an outer spring biasing a valve body bearing the inner spring, wherein the outer spring is captured within the retainer such that the outer spring does not exert a force on a connection between the valve assembly and the neck portion of the liner.

6. The beer keg assembly of claim 1 wherein the retainer further includes an outer retainer secured to an inner retainer portion and wherein the outer retainer is secured to an outer surface of the neck portion.

7. The beer keg assembly of claim 1 further including a pressure relief valve disposed in a fluid path leading through a wall of the retainer.

8. The beer keg assembly of claim 7 wherein the retainer includes an inner retainer portion having an inner annular surface formed on a portion of reduced diameter against which upward force from the inner spring bears via the port and the piston, wherein the fluid path of the pressure relief valve extends through the inner retainer portion below the inner annular surface.

9. A beer keg assembly comprising:

a liner having a body portion and a neck portion; and a valve assembly in the neck portion of the liner, the valve assembly including a retainer having an annular wall sealing against the neck portion, a fluid passage extending through the annular wall, a pressure relief valve in the fluid passage.

10. The beer keg assembly of claim 9 wherein the pressure relief valve is secured within the annular wall of the retainer.

11. The beer keg assembly of claim 10 wherein the retainer includes an inner retainer portion including the annular wall, the retainer further including an outer retainer portion secured to the inner retainer portion and secured to the neck portion.

12. The beer keg assembly of claim 11 wherein the fluid passage extends through the inner retainer portion and the outer retainer portion.

13. The beer keg assembly of claim 12 wherein the inner retainer portion has an inner annular surface formed on a portion of reduced diameter against which upward force from an inner spring bears via a port and a piston, wherein the fluid passage of the pressure relief valve extends through the inner retainer portion below the inner annular surface.

14. The beer keg assembly of claim 13 further including an outer container, the liner received in the outer container, a lid secured to the outer container and having an opening, a portion of the valve assembly extending through the opening in the lid, the beer keg assembly further including a locking ring secured to the outer retainer portion such that the lid is between the locking ring and the liner.

15. The beer keg assembly of claim 11 further including an outer container, the liner received in the outer container, a lid secured to the outer container and having an opening, a portion of the valve assembly extending through the opening in the lid further including a locking ring secured to the outer retainer portion such that the lid is between the locking ring and the liner.

16. The beer keg assembly of claim 9 further including an outer container, the liner received in the outer container, a lid secured to the outer container and having an opening, a portion of the valve assembly extending through the opening in the lid.

17. The beer keg assembly of claim 9 wherein the pressure relief valve includes a cap having an aperture therethrough and a spring biasing a piston away from the cap against a sealing surface.

18. The beer keg assembly of claim 17 wherein the cap and piston are made from POM.

19. A beer keg assembly comprising:

a liner having a body portion and a neck portion; and a valve assembly in the neck portion of the liner, the valve assembly including an inner retainer portion having an inner annular surface formed on a portion of reduced diameter, a cap secured to the inner retainer portion, at least one spring imparting force between the cap and the inner annular surface.

20. The beer keg assembly of claim 19 wherein the at least one spring includes an inner spring biasing a piston and a port against one another.

21. The beer keg assembly of claim 20 wherein the at least one spring further includes an outer spring, wherein the inner spring and the outer spring are both captured between the inner annular surface and the cap.

22. The beer keg assembly of claim 21 wherein the cap is snap-fit to the inner retainer portion.

23. The beer keg assembly of claim 22 further including an outer container, the liner received in the outer container, a lid secured to the outer container and having an opening, a portion of the valve assembly extending through the opening in the lid.

24. The beer keg assembly of claim 23 wherein the outer container is formed of plastic and the liner is formed of PET.

25. The beer keg assembly of claim 19 further including a pressure relief valve disposed in a fluid path leading through a wall of the inner retainer portion.

26. A beer keg assembly comprising:

a liner having a body portion and a neck portion; and a valve assembly in the neck portion of the liner, the valve assembly including a retainer capturing an inner spring biasing a port and a piston toward one another, wherein the retainer further includes an outer retainer secured to an inner retainer portion and wherein the outer retainer is secured to an outer surface of the neck portion.

27. The beer keg assembly of claim 26 further including an outer container, the liner received in the outer container, a lid secured to the outer container and having an opening, a portion of the valve assembly extending through the opening in the lid.

28. The beer keg assembly of claim 27 wherein the neck portion of the liner is externally threaded.

29. The beer keg assembly of claim 28 wherein the outer container is molded of plastic and the liner is formed of PET.

30. The beer keg assembly of claim 29 wherein the inner retainer portion has an inner annular surface formed on a portion of reduced diameter, a cap secured to the inner retainer portion, an outer spring imparting force between the cap and the inner annular surface.

31. A beer keg assembly comprising:

a liner having a body portion and a neck portion;

a valve assembly in the neck portion of the liner, the valve assembly including a retainer capturing an inner spring biasing a port and a piston toward one another; and a pressure relief valve disposed in a fluid path leading through a wall of the retainer.

32. The beer keg assembly of claim 31 further including an outer container, the liner received in the outer container, a lid secured to the outer container and having an opening, a portion of the valve assembly extending through the opening in the lid.

33. The beer keg assembly of claim 32 wherein the neck portion of the liner is externally threaded.

34. The beer keg assembly of claim 32 wherein the outer container is molded of plastic and the liner is formed of PET.

35. The beer keg assembly of claim 34 wherein the fluid path is disposed outside of the neck portion of the liner.

* * * * *